US009140062B2

(12) United States Patent
Cuatepotzo et al.

(10) Patent No.: US 9,140,062 B2
(45) Date of Patent: Sep. 22, 2015

(54) EASY ROLL STIFF SCREEN

(71) Applicants: Rubén Cuatepotzo, Tlaxcala (MX); Victor Manuel Castro, Tlaxcala (MX)

(72) Inventors: Rubén Cuatepotzo, Tlaxcala (MX); Victor Manuel Castro, Tlaxcala (MX)

(73) Assignee: SAINT-GOBAIN ADFORS CANADA, LTD., Grand Island, NY (US)

( * ) Notice: Subject to any disclaimer, the term of this patent is extended or adjusted under 35 U.S.C. 154(b) by 0 days.

(21) Appl. No.: 13/853,512

(22) Filed: Mar. 29, 2013

(65) Prior Publication Data

US 2014/0060758 A1 Mar. 6, 2014

Related U.S. Application Data

(60) Provisional application No. 61/617,828, filed on Mar. 30, 2012.

(51) Int. Cl.

| | |
|---|---|
| ***E06B 9/40*** | (2006.01) |
| ***D03D 1/00*** | (2006.01) |
| ***D03D 15/00*** | (2006.01) |

(Continued)

(52) U.S. Cl.

CPC ..... *E06B 9/40* (2013.01); *D03D 1/0017* (2013.01); *D03D 1/0035* (2013.01); *D03D 7/00* (2013.01); *D03D 9/00* (2013.01); *D03D 15/0011* (2013.01); *D03D 15/0027* (2013.01); *D03D 15/02* (2013.01); *E06B 9/54* (2013.01); *D10B 2101/06* (2013.01); *D10B 2101/20* (2013.01); *D10B 2321/021* (2013.01); *D10B 2321/022* (2013.01); *D10B 2331/02* (2013.01); *D10B 2331/04* (2013.01); *D10B 2503/03* (2013.01); *Y10T 428/24983* (2015.01)

(58) Field of Classification Search

USPC ..... 160/238, DIG. 7, 371, 23.1, 31, 264
IPC ..... E06B 9/40
See application file for complete search history.

(56) References Cited

U.S. PATENT DOCUMENTS 2,110,048 A * 3/1938 May ..... 160/300
2,333,618 A * 11/1943 Strauss ..... 442/49

(Continued)

FOREIGN PATENT DOCUMENTS

JP 06253970 A 9/1994
WO 2004088078 A2 10/2004

OTHER PUBLICATIONS

International Search Report for PCT/US2013/034609 dated Jul. 15, 2013, 2 pages.

*Primary Examiner* — David Purol
(74) *Attorney, Agent, or Firm* — Abel Law Group, LLP; Robert N. Young

(57) ABSTRACT

A woven screen can include at least one first fiber oriented in a main direction of the woven screen and having a polymer coating and a first stiffness value, and at least one second fiber oriented in a direction of the woven screen different from the main direction, configured to intersect with the at least one first fiber, and having a modified polymer coating and a second stiffness value about 20% to about 70% greater than the first stiffness value. The modified polymer coating can include a polymer, a crosslinking agent, a catalyst, and a free radical initiator. The at least one first fiber can include the warp and the at least one second fiber can include the weft, respectively, of the woven screen. The second stiffness value can be about 40% greater than the first stiffness value over a temperature range of about −40° Celsius to about +40° Celsius.

20 Claims, 2 Drawing Sheets

(51) Int. Cl.

| | |
|---|---|
| ***D03D 15/02*** | (2006.01) |
| ***D03D 7/00*** | (2006.01) |
| ***E06B 9/54*** | (2006.01) |
| ***D03D 9/00*** | (2006.01) |

(56) References Cited

U.S. PATENT DOCUMENTS

| | | | | | |
|---|---|---|---|---|---|
| 2,364,404 | A | * | 12/1944 | Thomas | 139/420 R |
| 2,817,371 | A | * | 12/1957 | Bussiere | 139/383 R |
| 3,417,794 | A | * | 12/1968 | Lynch et al. | 139/420 C |
| 4,463,790 | A | | 8/1984 | Clapsaddle | |
| 4,587,997 | A | * | 5/1986 | Brooks | 139/420 R |
| 5,123,474 | A | | 6/1992 | Smith | |
| 5,392,835 | A | | 2/1995 | Wildt | |
| 5,438,780 | A | | 8/1995 | Winner | |
| 6,119,758 | A | | 9/2000 | Coenraets | |
| 6,171,984 | B1 | * | 1/2001 | Paulson et al. | 442/331 |
| 6,209,610 | B1 | | 4/2001 | Davies et al. | |
| 6,397,920 | B1 | * | 6/2002 | Forin | 160/238 |
| 6,691,761 | B1 | | 2/2004 | Alkhoury et al. | |
| 6,823,924 | B2 | | 11/2004 | Martin | |
| 2001/0000878 | A1 | | 5/2001 | Davies et al. | |
| 2002/0134709 | A1 | * | 9/2002 | Riddle | 209/238 |
| 2006/0169426 | A1 | * | 8/2006 | McGregor et al. | 160/371 |
| 2006/0225847 | A1 | | 10/2006 | Davies et al. | |
| 2007/0193697 | A1 | | 8/2007 | Horvath | |
| 2007/0272365 | A1 | | 11/2007 | Wingert et al. | |
| 2009/0104829 | A1 | * | 4/2009 | Bredemus et al. | 442/1 |
| 2010/0263271 | A1 | | 10/2010 | DeKoning et al. | |
| 2011/0183567 | A1 | * | 7/2011 | Vedula et al. | 442/328 |
| 2013/0045351 | A1 | | 2/2013 | Spanton et al. | |

* cited by examiner

EASY ROLL STIFF SCREEN

CROSS-REFERENCE TO RELATED APPLICATION

The present application claims priority from U.S. Provisional Patent Application No. 61/617,828, filed Mar. 30, 2012, entitled "EASY ROLL STIFF SCREEN," naming inventors Rubén Cuatepotzo and Víctor Manuel Castro, which application is incorporated by reference herein in its entirety.

FIELD OF THE DISCLOSURE

The present disclosure relates to woven screens and to methods of making the woven screens.

BACKGROUND

Woven screens, such as a retractable screen used to cover a window opening, are susceptible to permanent deformation. Some woven screens may have high stiffness values, both in the directions parallel to and perpendicular to the direction in which the screen is unrolled, to prevent wrinkles and to improve the appearance of the screen when it is unrolled to cover the window. The high stiffness values of the woven screen impart, however, a type of memory to the woven screen that may cause it to recoil within a storage housing to recover its original unrolled shape. The attempt to recoil may cause the woven screen to be permanently deformed and may cause a jam in the storage housing, particularly at lower ambient temperatures. Excessive force may also be applied to the woven screen to remove deformations or to resolve the jam, causing further damage to the woven screen and the storage housing.

Accordingly, there is a need for an improved woven screen.

SUMMARY

In an embodiment, a woven screen includes at least one first fiber oriented in a main direction of the woven screen and having a polymer coating, wherein the at least one first fiber has a first stiffness value; and at least one second fiber oriented in a cross direction of the woven screen and having a modified polymer coating, wherein the cross direction is different than the main direction, wherein the at least one first fiber and the at least one second fiber are configured to intersect, and wherein the at least one second fiber has a second stiffness value between about 20% and about 70% greater than the first stiffness value.

In another embodiment, a method of making a woven screen includes orienting in a main direction of the woven screen at least one first fiber having a polymer coating, wherein the at least one first fiber has a first stiffness value; orienting in a cross direction of the woven screen at least one second fiber having a modified polymer coating, wherein the cross direction is different than the main direction, wherein the at least one first fiber and the at least one second fiber are configured to intersect, and wherein the at least one second fiber has a second stiffness value between about 20% and about 70% greater than the first stiffness value; weaving the at least one first fiber together with the at least one second fiber to form the woven screen; and fixing the woven screen with heat.

In yet another embodiment, a woven window screen includes at least one first fiber including the warp of the woven window screen and having a polymer coating, wherein the at least one first fiber has a first stiffness value; and at least one second fiber including the weft of the woven window screen and having a modified polymer coating, wherein the at least one first fiber and the at least one second fiber are configured to intersect, and wherein the at least one second fiber has a second stiffness value about 40% greater than the first stiffness value over a temperature range of between about −40° Celsius and about +40° Celsius.

In still another embodiment, a method of making a woven window screen includes orienting as the warp of the woven window screen at least one first fiber having a polymer coating, wherein the at least one first fiber has a first stiffness value; orienting as the weft of the woven window screen at least one second fiber having a modified polymer coating, wherein the at least one first fiber and the at least one second fiber are configured to intersect, and wherein the at least one second fiber has a second stiffness value about 40% greater than the first stiffness value over a temperature range of between about −40° Celsius and about +40° Celsius; weaving the at least one first fiber together with the at least one second fiber using a plain weave to form the woven window screen; and fixing the woven window screen with heat.

BRIEF DESCRIPTION OF THE DRAWINGS

Embodiments are illustrated by way of example and are not limited in the accompanying figures.

Figure 1:
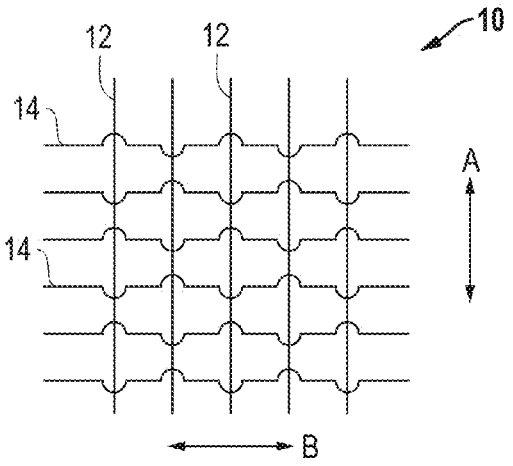
FIG. 1 includes an illustration of a woven screen in accordance with an embodiment described herein.

Skilled artisans appreciate that elements in the figures are illustrated for simplicity and clarity and have not necessarily been drawn to scale. For example, the dimensions of some of the elements in the figures may be exaggerated relative to other elements to help to improve understanding of embodiments of the invention.

DETAILED DESCRIPTION

The following description in combination with the figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be used in this application.

Before addressing details of the embodiments described below, some terms are defined or clarified. The term "stiffness value" is intended to mean the stiffness of a material in a given direction and is measured in milligrams by a Gurley tester in accordance with ASTM-D3656. The term "warp" is intended to denote the fibers running lengthwise, or parallel to a machine direction, within the woven screen and the term "weft" is intended to denote the fibers running widthwise, or parallel to a cross direction, in the woven screen.

As used herein, the terms "comprises," "comprising," "includes," "including," "has," "having" or any other variation thereof, are intended to cover a non-exclusive inclusion. For example, a method, article, or apparatus that comprises a list of features is not necessarily limited only to those features but may include other features not expressly listed or inherent to such method, article, or apparatus. Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

Also, the use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise. For example, when a single item is described herein, more than one item may be used in place of a single item. Similarly, where more than one item is described herein, a single item may be substituted for that more than one item.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and may be found in reference books and other sources within the structural arts and corresponding manufacturing arts.

The present invention provides a woven screen including at least one first fiber and at least one second fiber. The at least one first fiber is oriented in a main direction of the woven screen, has a polymer coating, and further has a first stiffness value. The at least one second fiber is oriented in a cross direction of the woven screen that is different from the main direction and has a modified polymer coating. The at least one second fiber further has a second stiffness value that is between about 20% to about 70% greater than the first stiffness value. A woven screen with the at least one first fiber, the at least one second fiber, and the first and second stiffness values as respectively described can resist deformation even as it is rolled and unrolled repeatedly over any reasonable range of ambient temperatures.

The woven screen can include one or more of the at least one first fiber, such as a plurality of first fibers. The woven screen also can include one or more of the at least one second fiber, such as a plurality of second fibers. In an embodiment, one or more of the first and/or second fibers may be described as monofilaments. Skilled artisans will appreciate, however, that each of the first fibers and second fibers may include other configurations. For example, one or more of the first fibers and the second fibers may include a multi-strand, plied or unplied (e.g., ordered or unordered) configuration of one or more suitable materials. In an embodiment, the multi-strand plied configuration includes an ordered configuration such as a yarn. One or more of the first fibers and the second fibers also may include a multi-strand unordered configuration, such as a roving. Any suitable configuration for each of the first and second fibers is envisioned. In an embodiment, the first and second fibers include the same configuration. In another embodiment, the first and second fibers include different configurations.

Any suitable materials for each of the first and second fibers, including any suitable organic or inorganic material, are envisioned for the woven screen. In an embodiment, suitable materials include any polymeric material (e.g., polyester), any metal material, or fiberglass. In an embodiment, one or more of the first fibers and the second fibers are multifilaments of fiberglass. In another embodiment, one or more of the first fibers and the second fibers may include monofilaments or multifilaments of steel, aluminum, polyethylene, polypropylene, polyamide, or any combination thereof. In an embodiment, the first fibers and the second fibers may be the same or different materials.

Any suitable dimension for each of the first fibers and the second fibers is also envisioned for the woven screen, whether the fibers are in a monofilament or multifilament configuration. In an embodiment, each of the first fibers and the second fibers can include various diameters. For example, the diameter of one or more of the first fibers and the second fibers can include a diameter in the range of between about 120 microns and about 635 microns. In an embodiment, one or more of the first fibers and the second fibers include the same diameter. In another embodiment, one or more of the first fibers and the second fibers include different diameters.

The polymer coating for one or more of the first fibers includes any reasonable polymer. In an embodiment, the polymer coating on a first fiber includes polyvinyl chloride (PVC), polyethylene, polypropylene, polyamide, or any combination of these polymers. In a particular embodiment, the polymer coating is plastisol and the plastisol includes a dispersion of PVC within a blending resin, a plasticizer, and one or more additives. In another embodiment, the polymer coating includes other suitable additives, such as colorants, stabilizers, surfactants or thickeners. In a further embodiment, the polymer coating consists essentially of a polymer.

The modified polymer coating for one or more of the second fibers also includes any reasonable polymer. In an embodiment, the modified polymer coating includes polyvinyl chloride (PVC) such as a dispersion of PVC within a blending resin, polyethylene, polypropylene, polyamide, or any combination of these polymers. In an embodiment, any reasonable amount of a PVC resin is envisioned for the modified polymer coating. For instance, the PVC resin is present in an amount of between about 55 wt. % and about 65 wt. %, based on the total weight of the modified polymer coating. In a particular embodiment, the modified polymer coating includes the same polymer as the polymer coating on the first fibers. In another embodiment, the modified polymer coating includes a modified plastisol polymer. In yet another embodiment, the modified polymer coating includes a different polymer than the polymer coating used to coat the first fibers. In an embodiment, the polymer coating on the first fibers is substantially free of crosslinking, catalyst, and free radical additives that are typically present in the modified polymer coating. "Substantially free," as used herein, refers to less than about 0.1% wt. % of each of the crosslinking, catalyst, and free radical additives.

The thickness of each of the polymer coating and the modified polymer coating on their respective fibers includes any reasonable range of thicknesses. In a particular embodiment, each of the polymer coating and the modified polymer coating can include a thickness of between about 30 microns and about 200 microns on a first fiber and a second fiber, respectively. Each of the polymer coating and the modified polymer coating also coat any suitable amount of each fiber. For example, each of the polymer coating and the modified polymer coating can coat substantially all of a first fiber and a second fiber, respectively. In another embodiment, each of the polymer coating and the modified polymer coating can coat at least 50% of a first fiber and a second fiber respectively, such as at least 60%, at least 70%, or even at least 75%. In yet another embodiment, each of the polymer coating and the modified polymer coating can include a uniform coating, a homogenous coating, or a continuous coating on a first fiber and a second fiber, respectively.

In addition to the polymer, the modified polymer coating can include any suitable crosslinking agents, catalysts, and free radical initiators. In an embodiment, the crosslinking agent includes a monomer, an acrylate, a peroxide, an azo compound, or a combination of these agents. Any reasonable amount of crosslinking agent is envisioned. For instance, the crosslinking agent is present in an amount of between about 5 wt. % and about 15 wt. %, based on the total weight of the modified polymer coating. In a particular embodiment, the crosslinking agent is an acrylate. In an embodiment, the catalyst includes any reasonable catalyst such as an organic cobalt salt or any different reasonable organometallic catalyst, or a combination thereof. Any reasonable amount of catalyst is envisioned. For instance, the catalyst is present in an amount of between about 0.001 wt. % and about 0.005 wt. %, based on the total weight of the modified polymer coating. In a particular embodiment, the catalyst includes an organic cobalt salt. In an embodiment, the free radical initiator includes a peroxide, an azo compound, or a combination of these elements. Any reasonable amount of free radical initiator is envisioned. For instance, the free radical initiator is present in an amount of between about 0.2 wt. % and 0.5 wt. %, based on the total weight of the modified polymer coating.

In an embodiment, the modified polymer coating can also include a plasticizer, a thermal stabilizer, a paste, an anti-static agent, a lubricant, or any combination of these substances. Any reasonable amount of plasticizer is envisioned and in an embodiment, the plasticizer may or may not include phthalate. In an embodiment, the plasticizer may include phthalate, such as terephthalate. In another embodiment, the plasticizer can include other suitable plasticizers, such as di- or tri-carboxylic acid ester based plasticizers, adipates, sebacates, maleates, trimellitates, or other biodegradable plasticizers. In an embodiment, the plasticizer is present in an amount of between about 10 wt. % and about 30 wt. %, such as in an amount of between about 10 wt. % and about 20 wt. %, based on the total weight of the modified polymer coating. The thermal stabilizer may include various materials such as barium or zinc, or a combination thereof. Any reasonable amount of thermal stabilizer is envisioned. For example, the thermal stabilizer is present in an amount of between about 1 wt. % and about 5 wt. %, based on the total weight of the modified polymer coating. In an embodiment, the paste may include pigments, an anti-flaming agent, and a plasticizer, all present in any reasonable amount. In an embodiment, the paste may be present in an amount of between about 3 wt. % and about 6 wt. %, based on the total weight of the modified polymer coating. In an embodiment, any reasonable anti-static agent may be present in an amount of between about 0.5 wt. % and about 1.5 wt. %, based on the total weight of the modified polymer coating. In a particular embodiment, the anti-static agent includes long carbon chain carboxylates. In an embodiment, any reasonable lubricant may be present in an amount of between about 0.1 wt. % and about 0.3 wt. %, based on the total weight of the modified polymer coating. In a particular embodiment, the lubricant is silicon oil.

Within the woven screen, the first fibers and the second fibers can be configured to intersect such that they may be woven together using any reasonable weave. In a particular embodiment, the first fibers and the second fibers are configured in a plain weave where each of the second fibers are carried over and under each of the first fibers, with each row of second fibers alternating, to produce a high number of intersections between the first fibers and the second fibers. In another embodiment, the first fibers and the second fibers can be configured in a leno weave where two or more first fibers can be twisted around each other as they are interlaced with one or more second fibers, or they can be configured in a half-leno weave. For each weave used, the woven screen and the configurations of the first fibers and the second fibers can also be altered by changing the densities (e.g., increasing or decreasing the number of fibers in a given distance, such as increasing or decreasing the number of fibers per inch) of either or both of the first fibers or the second fibers in their respective directions.

The directions in which the first fibers and the second fibers are oriented within the woven screen also include any reasonable orientations. For example, the first fibers can be oriented in a main direction of the woven screen, such as a direction that is parallel to the length of the woven screen. In an embodiment, the second fibers may be oriented in a direction of the woven screen that is different from the orientation of the first fibers, such as in a cross direction that is parallel to the width of the woven screen or perpendicular to the orientation of the first fibers. In a particular embodiment, the first fibers include the warp of the woven screen and the second fibers include the weft of the woven screen. In another particular embodiment, the warp is parallel to the direction in which the woven screen unrolls from a storage unit, such as a cassette housing for storing the woven screen, and the weft is perpendicular to the direction in which the woven screen rolls and unrolls.

The densities of each of the first fibers and the second fibers in the woven screen include any reasonable densities, depending on the purpose for which the woven screen is intended. In an embodiment, the density of each of the first fibers and the second fibers is between about 9 fibers per inch to about 60 fibers per inch in their respective directions. In a particular embodiment, the density of the first fibers is about 18 fibers per inch in a main direction and the density of the second fibers is about 16 fibers per inch in a cross direction different from the main direction to create a woven screen designed to prevent insects from entering through a window or passing through the woven screen. In other embodiments, the density of each of the first fibers and the second fibers may include configurations such as: 20×20, 20×18, 18×18, 18×16, and 18×14, where the first number is the density of the first fibers in the main direction of the woven screen and the second number is the density of the second fibers in the cross direction of the woven screen.

The first stiffness value and the second stiffness value include any reasonable range of values, where the second stiffness value is greater than the first stiffness value by about 20% to about 70%. In an embodiment, the first stiffness value is between about 140 mg and 190 mg and the second stiffness value is between about 180 mg and 230 mg. In another embodiment, the first stiffness value is between about 140 mg and 160 mg and the second stiffness value is between about 180 mg and 220 mg. In a particular embodiment, the second stiffness value is about 40% greater than the first stiffness value over a temperature range of about −40° Celsius to about +40° Celsius. Skilled artisans will recognize that, although the first and second stiffness values may change depending on the particular temperature at which the stiffness values are measured (within a range of ambient temperatures), the second stiffness value can still be greater than the first stiffness value by about 20% to about 70% at that particular temperature.

The woven screen can include a variety of dimensions and is useful for both indoor and outdoor applications. For example, the width of the woven screen can be between about 0.2 meters and about 2.7 meters and the length of the woven screen can be between about 2 meters and about 1,100 meters. In an embodiment, the woven screen may be part of an indoor window covering system that includes a retractable screen to prevent insects from entering through the window by passing through the woven screen. In a particular embodiment, the woven screen may be attached to a coil system residing within a cassette housing or other storage system that stores and protects the woven screen and is attached to the frame of the window to be covered by the woven screen. The woven screen can be unrolled from the coil system by any reasonable means, including by a pull bar means that is attached to one edge of the woven screen and that allows a user to pull downwards on the pull bar to unroll the woven screen through an opening in the cassette housing. The first fibers can be oriented parallel to the length of the woven screen, including parallel to the direction in which the woven screen is unrolled. The second fibers, with a stiffness value between about 20% and about 70% greater than the stiffness value of the first fibers, can be oriented parallel to the width of the woven screen. The pull bar can also be used to retract the woven screen by causing it to roll back around the coil system. The greater stiffness value of the second fibers can enable the woven screen to resist deformation caused by the rolling movement of the woven screen and the pulling action of the user on the pull bar. The lesser stiffness value of the first fibers allows the woven screen to unroll and reroll easily without causing a jam or other defect to the woven screen or the coil system. The woven screen and coil system can be used repeatedly without deformation as described above over any reasonable range of temperatures, including a temperature range of about −40° Celsius to about +40° Celsius. In other embodiments, the woven screen may be used as a fence or to provide a mesh covering for vents, tents, porches, and patios.

Turning to a method of making the woven screen, at least one first fiber and at least one second fiber as described above are provided. In an embodiment, each of the first fibers are coated with the polymer coating and each of the second fibers are coated with the modified polymer coating by any reasonable coating method, such as by a dip coating or extrusion coating method. In a particular embodiment, both of the first fibers and the second fibers are coated with their respective coatings via an extrusion process. For example, an extrusion process can be used to coat fiberglass fibers or polyester fibers with a PVC polymer or other polymer or a modified polymer coating, as appropriate. In a particular embodiment, the density of the first fibers in the woven screen and the thickness of the polymer coating on the first fibers are such that the first fibers can be configured to provide a first stiffness value of between about 140 mg and about 190 mg for the first fibers. In a further particular embodiment, the density of the second fibers in the woven screen and the thickness of the modified polymer coating on the second fibers are such that the second fibers can be configured to provide a second stiffness value of between about 180 mg and about 230 mg for the second fibers.

Once coated, the first fibers and the second fibers may be oriented in any two reasonable orientations and configured to intersect in preparation for being woven together. Any reasonable weaving technique is envisioned. The first fibers are oriented in the main direction of the woven screen which, in a particular embodiment, can include the warp of the woven screen while the second fibers are oriented in a different direction, such as the cross direction of the woven screen which, in an embodiment, can include the weft of the woven screen. In another particular embodiment, the first fibers are oriented in a direction that includes the weft of the woven screen and the second fibers are oriented in a direction that includes the warp of the woven screen. The first fibers and the second fibers are woven together using a plain weave, a leno weave, or a half leno weave as described above or using any other reasonable weaving technique. For example, the first fibers and the second fibers can be woven together using machines produced by Sulzer, Picanol, Dornier, or Smit Textile.

The woven screen can be fixed with any reasonable means to secure, or fix, the position of the first fibers and the second fibers relative to one another and their intersections within the woven screen and to impart the respective stiffness values to the first fibers and the second fibers by, for example, curing the polymer coating and the modified polymer coating. To "fix" the position of the first fibers and the second fibers relative to one another and their intersections, as used herein, is to refer to the position of the fibers relative to one another and their intersections as remaining unchanged even as the woven screen is unrolled and rolled up. In a particular embodiment, the woven screen is fixed using a heated means. Any reasonable heating temperature and conditions are envisioned depending upon the polymer coating and modified polymer coating chosen. For example, the heating temperature can include a value in the range of between about 160° Celsius to about 250° Celsius. The time needed to fix the woven screen can also include various times, including a curing time of between about 5 seconds to about 30 seconds, depending on the stiffness values required. In a particular embodiment, tentering or thermal bonding can be used to cure the polymer coating and modified polymer coating and to fix the intersections between the first fibers and the second fibers. In a further particular embodiment, the heat applied to the woven screen cures the polymer coating and the modified polymer coating at a single temperature, obviating the need for the modified polymer coating to be cured at a different temperature. Skilled artisans will further appreciate that any reasonable sequence of coating, curing or fixing, and weaving steps are envisioned to make the woven screen. In an embodiment, the curing or fixing of the first and second fibers can occur before the weaving together of the first and second fibers.

Turning to FIG. 1, a woven screen is illustrated. The woven screen 10 includes first fibers 12 that include a polymer coating (not shown) and have a first stiffness value and second fibers 14 that include a modified polymer coating (not shown) and have a second stiffness value as described above. First fibers 12 are oriented in a direction parallel to line A that, in an embodiment, can include the main direction of the woven screen. In an embodiment, line A is also parallel to the rolling and unrolling direction of woven screen 10. Second fibers 14 are oriented in a cross direction of the woven screen that is different than the main direction. That is, second fibers 14 are oriented in a direction parallel to line B that, in an embodiment, is perpendicular to line A and perpendicular to the rolling and unrolling direction of woven screen 10. In a particular embodiment, first fibers 12 comprise the warp of woven screen 10 and second fibers 14 comprise the weft of woven screen 10. First fibers 12 and second fibers 14 are configured to intersect in a plain weave, where each of second fibers 14 are carried over and under each of first fibers 12 and each row of second fibers 14 alternates to produce a high number of intersections of first fibers 12 and second fibers 14.

Figure 2A:
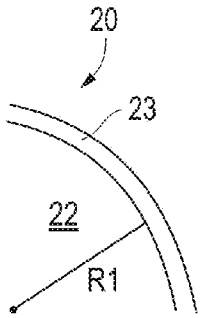
FIGS. 2A and 2B include partial cross-sectional views of a first fiber and a second fiber in accordance with an embodiment described herein.
Figure 2B:
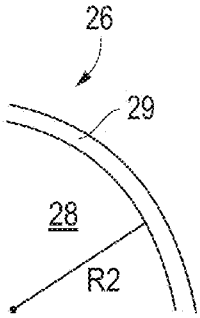

Turning to FIGS. 2A and 2B, partial cross-sectional views of at least one first fiber 20 and at least one second fiber 26 are provided. First fiber 20 includes monofilament 22 and polymer coating 23. Second fiber 26 includes monofilament 28 and modified polymer coating 29. In an embodiment, at least one of first fiber 20 and second fiber 26 can include a multifilament configuration 22 and 28. In a particular embodiment, monofilament 22 can include a radius R1, of any suitable distance, including a radius of between about 0.0045 inches and about 0.008 inches. In another embodiment, monofilament 28 also can include a radius R2, of any suitable distance, including a radius of between about 0.0045 inches to about 0.008 inches. In a particular embodiment, monofilament 22 and monofilament 28 are both fiberglass and R1 is equal to R2. In another embodiment, R1 can differ from R2.

Polymer coating 23 and modified polymer coating 29 can each include an appropriate thickness as described above. Polymer coating 23 includes any reasonable polymer, including plastisol, polyvinyl chloride (PVC), polyethylene, polypropylene, polyamide, or any combination of these polymers. Polymer coating 23 is applied to monofilament 22 using any reasonable coating method, including extrusion, and is bonded to monofilament 22 using any reasonable method. In an embodiment, polymer coating 23 is bonded to monofilament 22 using a thermal curing method at a particular temperature, including a temperature value in a range of between about 160° Celsius to about 250° Celsius, such that first fiber 20 obtains a first stiffness value as described above. Modified polymer coating 29 also includes any reasonable polymer and in an embodiment, includes the same polymer as polymer coating 23. In a particular embodiment, modified polymer coating 29 also includes a crosslinking agent, a catalyst, a free radical initiator, and one or more other substances, all included at any suitable concentration within the concentration ranges by weight specified in Table 1. Modified polymer coating 29 is applied to monofilament 28 using any reasonable coating method, including extrusion, and is bonded to monofilament 28 using any reasonable method. In an embodiment, modified polymer coating 29 is bonded to monofilament 28 using the same method, and at the same temperature, at which polymer coating 23 is bonded to monofilament 22, such that second fiber 26 obtains a second stiffness value as described above. The second stiffness value is between about 20% to about 70% greater than the first stiffness value. In a particular embodiment, the second stiffness value is about 40% greater than the first stiffness value, measured over a temperature range of about −40° Celsius to about +40° Celsius. First fiber 20 and second fiber 26 may be configured to intersect such that they may be woven together using any reasonable weaving technique, including a plain weave as illustrated by woven screen 10 in FIG. 1, prior to or after polymer coating 23 and modified polymer coating 29 have been bonded to monofilaments 22 and 28, respectively.

Figure 3:
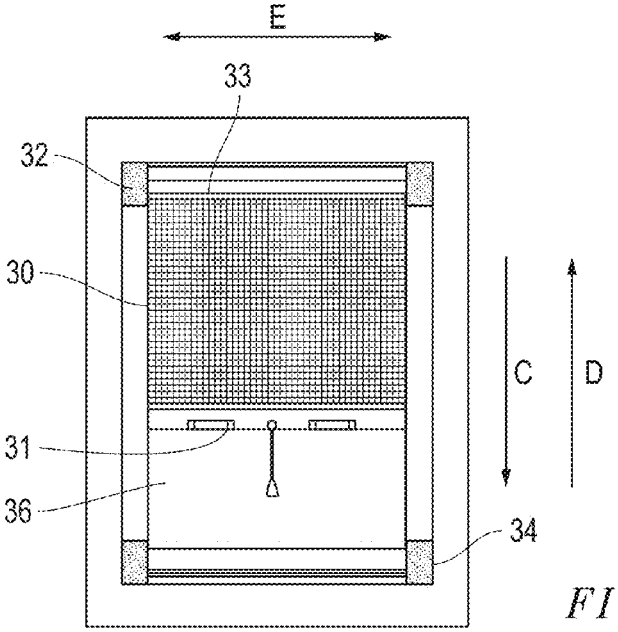
FIG. 3 includes an illustration of a woven window screen stored within a cassette housing in accordance with an embodiment described herein.

Turning to FIG. 3, a woven window screen stored within any reasonable storage means, such as a cassette housing, is illustrated. Woven screen 30 is stored within a cassette housing 32 that is attached to a window frame 34. Window frame 34 surrounds window 36. Woven screen 30 is attached to, and can be wound around, a coil system 33 also stored within cassette housing 32. Coil system 33 permits woven screen 30 to be unrolled in direction C by application of a downward force to pull bar 31 that is affixed to woven screen 30. Any other reasonable means by which woven screen 30 can be manipulated to cover window 36 is also envisioned. Coil system 33 also permits woven screen 30 to be rolled in direction D into cassette housing 32 and stored in a rolled up configuration. Woven screen 30 includes first fibers that are oriented in the woven screen to be parallel to directions C and D, have a polymer coating, and have a first stiffness value. Woven screen 30 also includes second fibers that are oriented in the woven screen to be parallel to line E and perpendicular to directions C and D, have a modified polymer coating, and have a second stiffness value. The second stiffness value is greater than the first stiffness value and, in an embodiment, is between about 20% to about 70% greater than the first stiffness value over a suitable range of ambient temperatures. When woven screen 30 is unrolled in direction C from coil system 33 using pull bar 31, the first fibers allow woven screen 30 to unroll smoothly to a selected position and to retain that position while the second fibers allow woven screen 30 to resist deformation or misalignment associated with unrolling woven screen 30 from coil system 33 by using pull bar 31 or another means. Deformation can include wrinkles, kinked or crimped fibers, tears or any other undesirable configuration of the fibers in woven screen 30. Misalignment can include any particular instance in which woven screen 30 is not aligned with window 36, coil system 33, or window frame 34 as desired. When woven screen 30 is rolled in direction D toward coil system 33, the first fibers allow woven screen 30 to roll smoothly into a rolled up configuration within cassette housing 32 and to retain that configuration without causing a jam or other defect to occur in coil system 33 while the second fibers allow woven screen 30 to resist deformation or misalignment associated with rolling up woven screen 30 into cassette housing 32 and coil system 33 by using pull bar 31 or another means. Woven screen 30 is able to repeatedly unroll and reroll smoothly, without deformation to woven screen 30 or damage to coil system 33 or cassette housing 32, over a range of temperatures. In an embodiment, the range of temperatures includes between about −40° Celsius to about +40° Celsius.

A woven screen as described above is able to avoid both deformation to the screen and the fibers within the screen and damage to the means of storing the woven screen. The woven screen is able to avoid deformation and damage despite repeated use of the woven screen over a range of temperatures. The following Table 1, describing possible components of the modified polymer coating, is provided to better disclose and teach processes and compositions of the present invention. It is for illustrative purposes only, and it must be acknowledged that minor variations and changes can be made without materially affecting the spirit and scope of the invention as recited in the claims that follow.

TABLE 1

| Components of Modified Polymer Coating | Concentration range (%) by weight |
|---|---|
| PVC resin | 55-65 |
| Plasticizer | 10-30 |
| Crosslinking agent | 5-15 |
| Thermal stabilizer | 1-5 |
| Paste | 3-6 |
| Anti-static agent | 0.5-1.5 |
| Lubricant | 0.1-0.3 |
| Free radical initiator | 0.2-0.5 |
| Catalyst | 0.001-0.005 |

EXAMPLE

A woven screen as described herein was tested to measure first and second stiffness values, also as described herein, over a range of ambient temperatures. To measure the first stiffness value, a 1.0 inch (in the cross direction) by 1.5 inch (in the main direction) sample of the woven screen was used. To measure the second stiffness value, a 1.0 inch (in the main direction) by 1.5 inch (in the cross direction) sample of the woven screen was used. The stiffness values were measured at the following ambient temperatures: 16.5° C., 20.5° C., and 22° C. The measured stiffness values are listed below in Table 2.

TABLE 2

| Temperature (° C.) | First Stiffness Value (mg) | Second Stiffness Value (mg) |
|---|---|---|
| 16.5 | 186.1 | 223.7 |
| 20.5 | 178.56 | 216.05 |
| 22 | 172.42 | 207.92 |

The second stiffness value is greater than the first stiffness value over a range of ambient temperatures. At each of the temperatures tested in Table 2, the second stiffness value is at least about 20% greater than the first stiffness value. The measured stiffness values are also plotted in FIG. 4.

Figure 4:
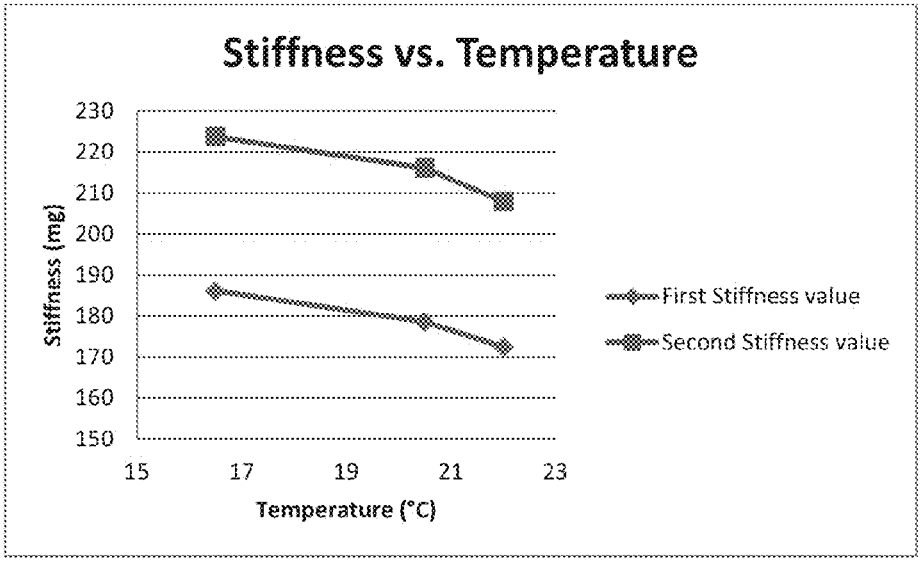
FIG. 4 includes a graph of measured stiffness values in accordance with an embodiment described herein.

A stiffness value of a fiber can vary when exposed to different ambient temperatures. FIG. 4 shows that stiffness values can decrease as the ambient temperature increases. Despite the change in the ambient temperature, however, the second stiffness value is greater than the first stiffness value, such as at least about 20% greater than the first stiffness value. A woven screen with stiffness values as shown in Table 2 and FIG. 4 can resist deformation to the screen and the fibers within the screen, as well as damage to the means of storing the woven screen, even despite repeated use of the woven screen over a range of ambient temperatures.

Certain features, for clarity, described herein in the context of separate embodiments, may also be provided in combination in a single embodiment. Conversely, various features that are, for brevity, described in the context of a single embodiment, may also be provided separately or in any subcombination. Further, reference to values stated in ranges includes each and every value within that range.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

The specification and illustrations of the embodiments described herein are intended to provide a general understanding of the structure of the various embodiments. The specification and illustrations are not intended to serve as an exhaustive and comprehensive description of all of the elements and features of apparatus and systems that use the structures or methods described herein. Separate embodiments may also be provided in combination in a single embodiment, and conversely, various features that are, for brevity, described in the context of a single embodiment, may also be provided separately or in any subcombination. Further, reference to values stated in ranges includes each and every value within that range. Many other embodiments may be apparent to skilled artisans only after reading this specification. Other embodiments may be used and derived from the disclosure, such that a structural substitution, logical substitution, or another change may be made without departing from the scope of the disclosure. Accordingly, the disclosure is to be regarded as illustrative rather than restrictive.

What is claimed is:

1. A rollable woven screen comprising:

at least one first fiber comprising the warp and oriented in a main direction of said woven screen and having a polymer coating, wherein the at least one first fiber has a first stiffness value; and at least one second fiber comprising the weft and oriented perpendicular to the main direction of said woven screen and having a modified polymer coating different from the polymer coating, wherein the at least one first fiber and the at least one second fiber comprise the same material and are configured to intersect, the at least one second fiber has a second stiffness value between about 20% and about 70% greater than the first stiffness value, and the main direction is parallel to a rolling direction of the woven screen.

2. A rollable woven window screen comprising:

at least one first fiber of fiberglass comprising the warp of the woven window screen and having a polymer coating comprising plastisol, polyvinyl chloride (PVC), polyethylene, polypropylene, polyamide, or combinations thereof, wherein the polymer coating has a thickness within a range of between about 30 microns and about 200 microns, wherein the at least one first fiber has a first stiffness value; and at least one second fiber of fiberglass comprising the weft of the woven window screen and having a modified polymer coating different from the polymer coating, wherein the modified polymer coating comprises a polymer, a crosslinking agent, a catalyst, and a free radical initiator, and the modified polymer coating has a thickness within a range of between about 30 microns and about 200 microns, wherein the at least one first fiber and the at least one second fiber are oriented perpendicular to each other, the at least one first fiber is oriented in a main direction which is parallel to a rolling direction of the woven screen, the at least one first fiber and the at least one second fiber are configured to intersect, and the at least one second fiber has a second stiffness value about 40% greater than the first stiffness value over a temperature range of between about −40° Celsius to about +40° Celsius.

3. A method of making a rollable woven screen comprising:

orienting in a main direction of said woven screen at least one first fiber comprising the warp and having a polymer coating, wherein the at least one first fiber has a first stiffness value, and the main direction is parallel to a rolling direction of the woven screen;

orienting in a direction perpendicular to the main direction of said woven screen at least one second fiber comprising the weft and having a modified polymer coating different from the polymer coating, wherein the at least one first fiber and the at least one second fiber comprise the same material and are configured to intersect, and wherein the at least one second fiber has a second stiffness value between about 20% and about 70% greater than the first stiffness value;

weaving the at least one first fiber together with the at least one second fiber to form the woven screen; and fixing the woven screen with heat.

4. The woven screen of claim 1, wherein the polymer coating comprises plastisol, polyvinyl chloride (PVC), polyethylene, polypropylene, polyamide, or combinations thereof.

5. The woven screen of claim 1, wherein the modified polymer coating comprises a polymer, a crosslinking agent, a catalyst, and a free radical initiator.

6. The woven screen of claim 5, wherein the crosslinking agent comprises a monomer, an acrylate, a peroxide, an azo compound, or combinations thereof, and wherein the crosslinking agent has a concentration of about 5 wt. % to about 15 wt. % by weight of the total modified polymer coating.

7. The woven screen of claim 5, wherein the catalyst comprises an organic cobalt salt, an organometallic catalyst, or combinations thereof, and wherein the catalyst has a concentration of about 0.001 wt. % to about 0.005 wt. % by weight of the total modified polymer coating.

8. The woven screen of claim 5, wherein the free radical initiator comprises a peroxide, an azo compound, or combinations thereof, and wherein the free radical initiator has a concentration of about 0.2 wt. % to about 0.5 wt. % by weight of the total modified polymer coating.

9. The woven screen of claim 5, wherein the modified polymer coating further comprises a plasticizer, a thermal stabilizer, a paste, an anti-static agent, a lubricant, or combinations thereof.

10. The woven screen of claim 1, wherein the at least one first fiber and the at least one second fiber comprise monofilaments or multifilaments of fiberglass, steel, aluminum, polyester, polyethylene, polypropylene, polyamide, or combinations thereof.

11. The woven screen of claim 1, wherein the density of each of the at least one first fiber and the at least one second fiber is between about 9 fibers per inch and about 60 fibers per inch.

12. The woven screen of claim 1, wherein each of the polymer coating and the modified polymer coating has a thickness within a range of between about 30 microns and about 200 microns.

13. The woven screen of claim 1, wherein the second stiffness value is about 40% greater than the first stiffness value and wherein the first stiffness value and the second stiffness value are measured over a temperature range of between about −40° Celsius and about +40° Celsius.

14. The woven screen of claim 1, wherein the screen is stored within a protective cassette housing that includes a coil system for rolling and unrolling the screen.

15. The woven screen of claim 1, wherein the at least one first fiber and the at least one second fiber are configured in a plain weave.

16. The method of claim 3, further comprising storing the screen within a protective cassette housing and attaching to the screen a coil system for rolling and unrolling the woven screen.

17. The method of claim 3, further comprising weaving the at least one first fiber together with the at least one second fiber using a plain weave.

18. The rollable woven screen of claim 1, wherein the first stiffness value is between about 140 mg and 190 mg and the second stiffness value is between about 180 mg and 230 mg.

19. The rollable woven window screen of claim 2, wherein the first stiffness value is between about 140 mg and 190 mg and the second stiffness value is between about 180 mg and 230 mg.

20. The method of claim 3, wherein the first stiffness value is between about 140 mg and 190 mg and the second stiffness value is between about 180 mg and 230 mg.

* * * * *